US008814765B2

(12) United States Patent
Bernstein

(10) Patent No.: US 8,814,765 B2
(45) Date of Patent: Aug. 26, 2014

(54) EXERCISE DEVICE AND METHOD OF USE

(76) Inventor: Mark Bernstein, Palm Bay, FL (US)

( * ) Notice: Subject to any disclaimer, the term of this patent is extended or adjusted under 35 U.S.C. 154(b) by 581 days.

(21) Appl. No.: 13/045,649

(22) Filed: Mar. 11, 2011

(65) Prior Publication Data

US 2011/0224054 A1 Sep. 15, 2011

Related U.S. Application Data

(60) Provisional application No. 61/313,305, filed on Mar. 12, 2010.

(51) Int. Cl.
*A63B 21/22* (2006.01)

(52) U.S. Cl.
USPC ..... 482/110

(58) Field of Classification Search
USPC ..... 482/92, 110, 44–49
See application file for complete search history.

(56) References Cited

U.S. PATENT DOCUMENTS 983,372 A * 2/1911 Johnson ..... 482/106
3,013,806 A * 12/1961 Boyd ..... 280/78
3,708,164 A * 1/1973 Griffin ..... 482/46
3,867,787 A * 2/1975 Weinger ..... 446/274
4,042,244 A * 8/1977 Kakovitch ..... 273/109
4,356,915 A * 11/1982 Phillips ..... 206/315.1
4,429,487 A * 2/1984 Taylor et al. ..... 446/168
4,480,831 A * 11/1984 Muller-Deinhardt ..... 482/8
4,632,391 A * 12/1986 Orak ..... 482/110
D301,510 S * 6/1989 Orak ..... D21/684
4,901,999 A 2/1990 Schott
D312,855 S * 12/1990 Silvey ..... D21/662
D335,553 S * 5/1993 Conner ..... D30/160
5,269,261 A * 12/1993 McCance ..... 119/706
5,351,650 A * 10/1994 Graves ..... 119/707
5,517,948 A * 5/1996 Udelle et al. ..... 119/706
5,674,162 A * 10/1997 Ellingson et al. ..... 482/110
5,692,944 A * 12/1997 Pellicone ..... 446/170
5,809,938 A * 9/1998 Baiera et al. ..... 119/707
D405,563 S * 2/1999 Baiera et al. ..... D30/160
6,099,444 A * 8/2000 Domenge ..... 482/110
6,179,758 B1 * 1/2001 Domenge ..... 482/110
6,431,939 B1 * 8/2002 Roh et al. ..... 446/236
6,440,047 B1 * 8/2002 Huang ..... 482/148
6,450,928 B1 * 9/2002 Larkins, Jr. ..... 482/110
6,488,613 B1 * 12/2002 Domenge ..... 482/110
6,500,102 B1 * 12/2002 Domenge ..... 482/110
6,776,742 B2 8/2004 Domenge
7,094,182 B1 8/2006 Holten
7,175,572 B2 2/2007 Stonecipher
7,846,076 B2 * 12/2010 Salzwimmer et al. ..... 482/110
2002/0155781 A1 * 10/2002 Lee ..... 446/236
2003/0134727 A1 * 7/2003 Yu ..... 482/110
2005/0096200 A1 * 5/2005 Amann ..... 482/110

(Continued)

*Primary Examiner* — Stephen Crow
*Assistant Examiner* — Garrett Atkinson
(74) *Attorney, Agent, or Firm* — Christopher & Weisberg, P.A.

(57) ABSTRACT

A hand held exercise device for providing a user with a portable workout. The device may generally comprise a central handle diametrically disposed within and spanning across a ring element having a toroidally shaped inner chamber. Internal bumpers within the inner chamber act to limit the range of motion or travel of at least one mobile element within the inner chamber. Rotational forces imparted by the user upon the handle cause movement of the at least one mobile element that is responded to and countered with user muscle flexion. In this manner, a user may perform a satisfactory workout by continually imparting and then resisting rotation force in alternating clockwise and counterclockwise directions.

16 Claims, 5 Drawing Sheets

(56) References Cited

U.S. PATENT DOCUMENTS

2005/0192170 A1* 9/2005 Cleveland et al. ..... 482/148
2008/0227608 A1* 9/2008 Sapia ..... 482/110
2008/0242508 A1* 10/2008 Smith ..... 482/2
2009/0247375 A1* 10/2009 Smith ..... 482/110
2010/0190620 A1* 7/2010 Chen et al. ..... 482/110

* cited by examiner

EXERCISE DEVICE AND METHOD OF USE

CROSS REFERENCE TO RELATED APPLICATIONS

This application claims the benefit of provisional patent application Ser. No. 61/313,305, filed with the USPTO on Mar. 12, 2010, which is herein incorporated by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The present invention generally relates to exercise devices, more specifically, the present invention relates to generally handheld exercise devices that use and beneficially exploit the angular momentum of one or more free moving bodies rotating about a ring element of such devices.

2. Background Art

In recent years people have become more and more conscious of the need to exercise in order to maintain a healthy life-style. Many different types of exercise have become popular and some exercises are directed or devoted to improving various aspects of the body's fitness and performance. A comprehensive list of such types of exercises and exercise devices is, in today's society, overwhelming. Many people have become confused as to what exercise and what type of exercise device is suitable for their purposes. Thus, many types of exercise devices are of common knowledge to an informed consumer or physical fitness devotee. There are many examples of such exercise devices, including derivations of inertial-type exercise devices.

Much of the equipment developed in the prior art is relatively heavy or bulky, such as universal gyms and free weights. Due to their bulk and weight, these devices are not portable.

Although portable, lightweight devices have been known to exist, they generally do not provide a sufficient workout as they typically are simple weights merely scaled down to portable size. These include ankle, hand and wrist weights, weighing only a few pounds.

Thus, a user of such conventional exercising devices is often faced with the choice of operating heavy equipment or settling for less than a sufficient workout by using the heretofore known portable devices.

It is, therefore, an aspect of the present invention to provide an exercising device that is portable and yet provides a satisfactory workout.

BRIEF SUMMARY OF THE INVENTION

The present invention comprises a device and/or method that has one or more of the following features and/or steps, which alone or in any combination may comprise patentable subject matter.

In accordance with one embodiment of the present invention, an exercise device comprising a ring element having a toroidally shaped inner chamber therein, a handle disposed across the diameter of the ring element, wherein the handle comprises a first end and a second end each in communication with opposing sides of the ring element, and at least one mobile element disposed and movable within the toroidally shaped inner chamber to provide inertial resistance, wherein the external diameter of the at least one mobile element is less than the internal diameter of the toroidally shaped inner chamber.

It is an aspect of the present invention to provide an exercise device having a ring element with a handle fixed therein, whereby a user may grasp the handle and cause movement of at least one mobile element contained within the ring element.

Another aspect of the present invention is to provide an exercise device that increases physical strength, improves general muscle tone and coordination, and may stimulate the cardiovascular system of the user.

Another aspect of the present invention to provide an improved exercise device that comprises a ring element having a toroidally shaped inner chamber and at least one mobile element capable of circulating within the toroidally shaped inner chamber when the ring element is rhythmically rotated.

Still another aspect of the present invention is to provide an exercising device that may be economically constructed and thus be affordable by virtually everyone.

Yet still it is another aspect of the present invention to provide a device to improve coordination between the right and left sides of the body.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

This invention generally relates to exercise devices having a ring element and at least one mobile element movable therein, and, more particularly to an exercise device in which the at least one mobile element is movable within a toroidally shaped inner chamber of the ring element by cyclical motion, upon movement of the ring element by means of a handle or any other supporting structure capable of transferring the motion to the at least one ball.

Figure 1:
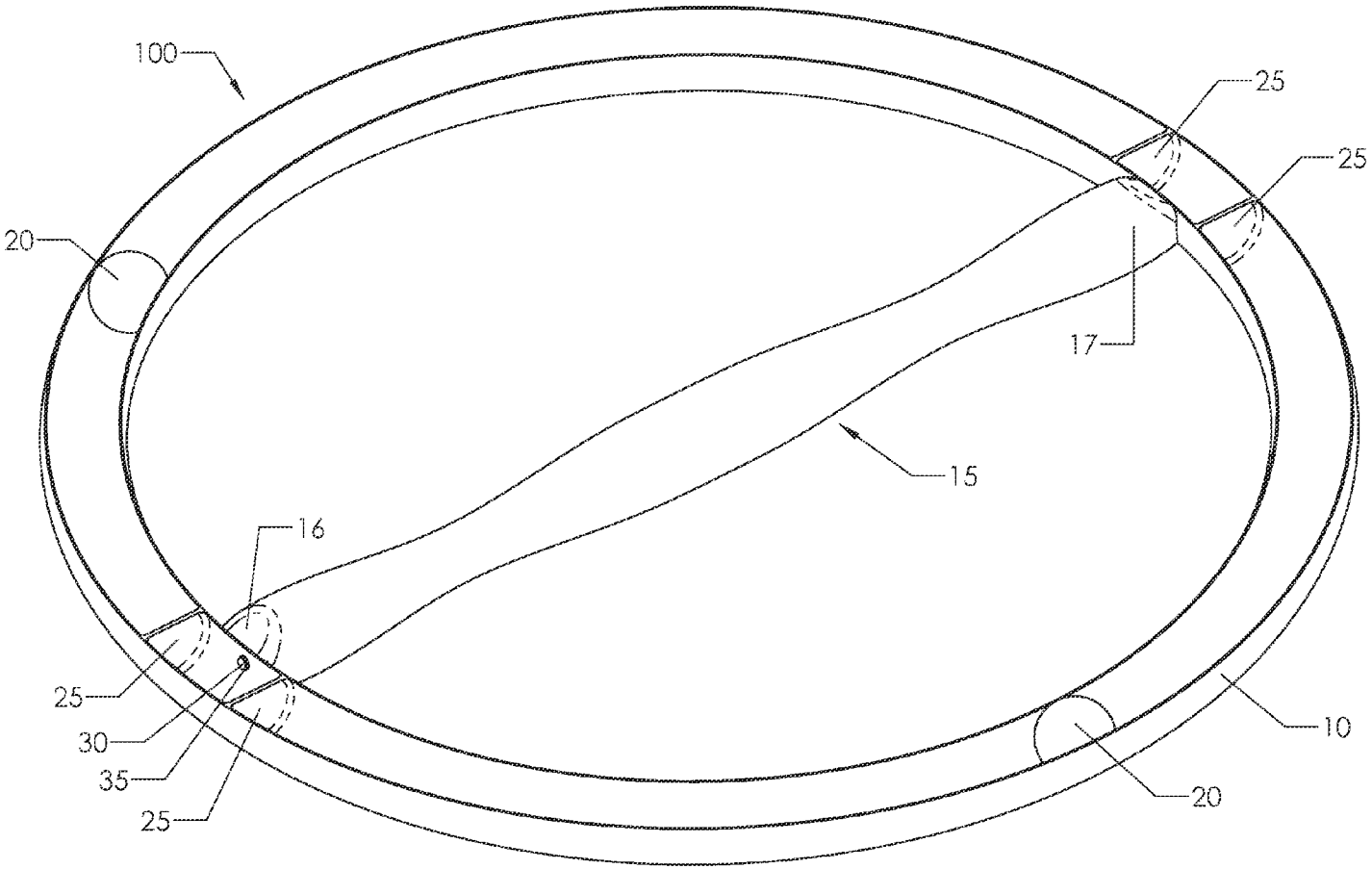
FIG. 1 depicts a perspective view of one embodiment of the device of the present invention.
Figure 2:
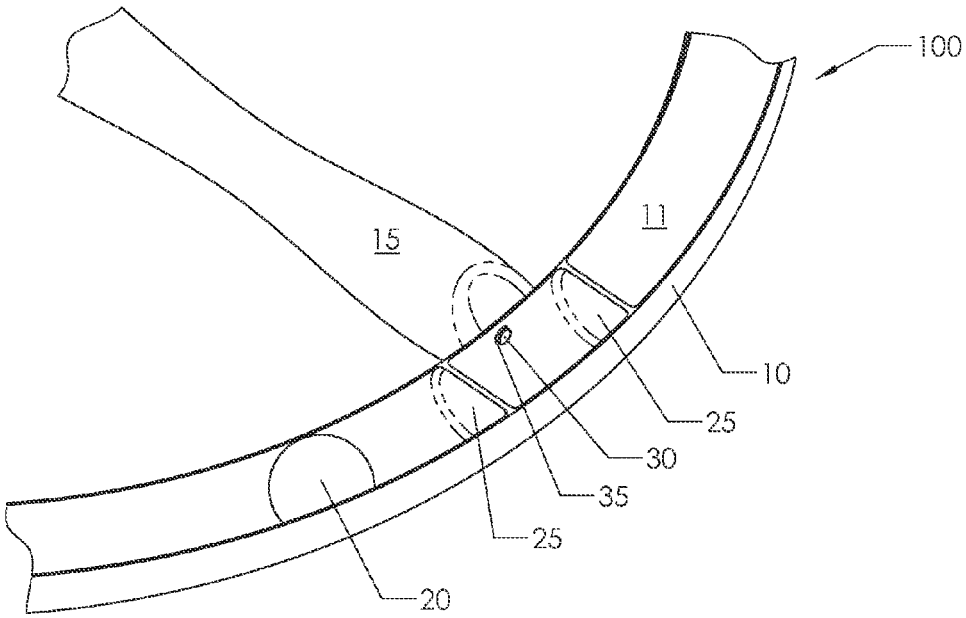
FIG. 2 depicts a close-up perspective view of the embodiment of the device of the present invention shown in FIG. 1.
Figure 3:
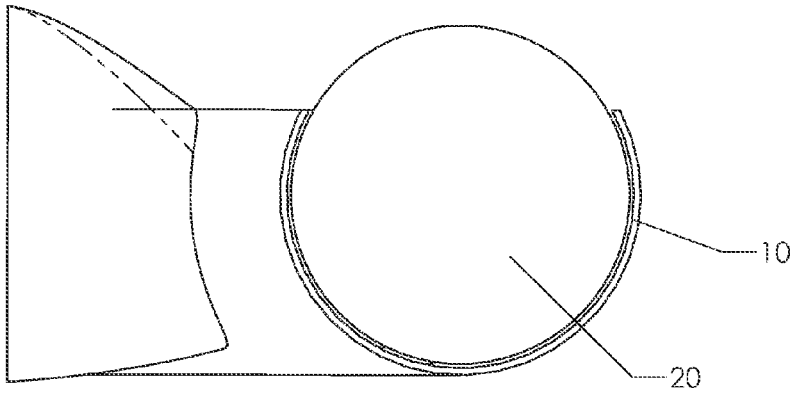
FIG. 3 depicts a cross sectional view of the embodiment of the device of the present invention shown in FIG. 1, wherein the view depicts the ring element and at least one mobile element.

One embodiment of an exercise device 100 of the present invention is illustrated in FIGS. 1-3. A first embodiment of the device 100 may generally comprises a ring element 10 having a toroidally shaped inner chamber 11 defined by the ring element 10. Within the center of the ring element 10, a handle 15 may span across the diameter of the ring element 10 from a first end 16 of the handle 15 to a second end 17 of the handle 15. As shown in FIGS. 1-3, at least one mobile element 20 may be disposed and movable within the toroidally shaped inner chamber 11 of the ring element 10.

In a preferred embodiment, the range of motion or travel of the at least one mobile element 20 may be restricted to two semi-circular pathways that are equal to or less than one half of the entirety of the toroidally shaped inner chamber 11 wherein at least one mobile element 20 may be disposed within each respective semi-circular pathway. An internal bumper 25 disposed at each end of the semi-circular pathway may provide the structure for limiting the range of motion or travel of the at least one mobile element 20 and/or reduce impact shock of the at least one mobile element 20. In such a preferred embodiment, two respective semi-circular pathways may be present, wherein each pathway may have at least one mobile element 20 disposed therein (see FIG. 1).

In a preferred embodiment of use, an individual may grasp the handle 15 with either one hand or both hands and rotate the device 100 within the plane of the ring element 10. The device 100 may be held with a user's arms bent or fully extended at the elbow and the device 100 may be statically maintained in one position or moved about the user's body during use. In other preferred examples of use, the device 100 may be held with one or both arms in a relaxed downward position with the device 100 in front, behind, or at either side of the user. As an alternative, the device 100 may be held at shoulder height with the device 100 in front, behind, or out to either side of the user. Still further, the device 100 may be held overhead by the user during use. The scope of the present invention includes any and all incremental angular positions located within a user's bodily range of motion.

The ring element 10 and the toroidally shaped inner chamber 11 defined therein may take one of several configurations. In a preferred embodiment, shown in FIGS. 1-7, the "top" of the ring element 10 may comprise a split-open top configuration. The split-open top may be very narrow (e.g. a thin slit) or the split-open top may be very wide (see FIGS. 1-7). As shown in FIG. 3, even with a wide split-open top the concave interior walls of the ring element 10 may encircle the circumference of each of the at least one mobile elements 20 to retain each of the at least one mobile elements 20 within the toroidally shaped inner chamber 11 no matter the orientation of the ring element 10. In this manner, the at least one mobile element 20 is free to move, roll, slide, and the like within the toroidally shaped inner chamber 11 while the at least one mobile element 20 is also retained and may be "snap-fit" within the inner chamber 11. In an alternative embodiment, the top surface of the ring element 10 may be completely solid thus obscuring any view of the at least one mobile element 20 therein. In narrow split-open top or solid-walled ring element 10 embodiments, one or more removable sections of a wall portion of the ring element 10 may allow for access to and/or replacement of the at least one mobile element 20.

The handle 15 of the device 100 may comprise a variety of configurations that allow for use by either one hand or two hands of a user. The handle 15 may be composed of rigid material or, alternatively, the handle 15 may be composed a flexible resilient material. In a preferred embodiment the handle 15 may be slim and ergonomic, as shown in FIGS. 1-2. Such a slim-gripped handle 15 may allow for maximum muscle rotation flex and an improved muscle rotation tone as compared to use of a larger diameter handle 15. Handle 15 may be unitary with the device 100 or the handle 15 may be removable to allow for the interchangeability of handles 15 and ring elements 10 that may change relative weights and/or materials of the components comprising the device 100. A preferred embodiment of a removable handle is shown in FIGS. 1-2 wherein a post 30 may be disposed on each of the first end 16 and second end 17 of the handle 15 wherein a complimentary post-hole 35 may be disposed at diametrically opposed portions of the inner circumference of the ring element 10. The flexibility or resiliency of the handle 15 and/or ring element 10 may provide for a secure connection that is releasable with the application of a sufficient amount of force to slightly deform either of the components to allow for removal of the handle 15 from the ring element 10. The scope of the present invention further includes all other manners known within the art for removably securing the handle 15 to the ring element 10 which may include but are not limited to complimentary screws and nuts or threaded recesses, tabs and grooves, and the like. A user's grip on the handle 15 may also be improved by providing any beneficial secure gripping surface known within the art including but not limited to an elastomeric or resilient outer coating, knurling, texturing, grooves, and the like on the outer surface of the handle 15.

The at least one mobile element 20 is disposed within the toroidally shaped inner chamber 11 of the ring element 10. In a preferred embodiment, the at least one mobile element 20 may comprise a spherical structure known within the art including but not limited to a steel ball capable of rolling within the inner chamber 11. In another preferred embodiment, the at least one mobile element 20 may comprise a cylindrical-shaped configuration that is capable of sliding within the inner chamber 11. The at least one mobile element 20 is movable within the inner chamber 11 to provide an ever changing resistance against the muscle flexion of the user. In alternate embodiments the at least one mobile element 20 may comprise multiple ball members or multiple cylindrical members including but not limited to two, three, four, five, or six mobile elements 20 disposed within the inner chamber 11. In other alternate embodiments, the at least one mobile element 20 comprise any shape configuration capable of sliding, rolling, or otherwise moving within the inner chamber 11 or the ring element 10.

The clearance of the at least one mobile element 20 in the inner chamber 11 should be sufficient to allow for free and unobstructed rolling, sliding, or other movement of the at least one mobile element 20 within the inner chamber 11. If the clearance is insufficient the diameter of the toroidally shaped inner chamber 11 may be increased by any means known within the art, and if the clearance is too large the diameter of the toroidally shaped inner chamber 11 may be decreased by any means known within the art. In a preferred embodiment, the clearance may be increased by sanding or otherwise abrading the inner surface of the ring element 10 to increase the internal diameter of the toroidally shaped inner chamber 11. In another preferred embodiment, the clearance may be decreased by first sanding or otherwise abrading the inner surface of the ring element 10 and thereafter applying an appropriate thickness of one or more paint layers onto the inner surface of the ring element 10 to decrease the internal diameter of the toroidally shaped inner chamber 11.

Figure 4:
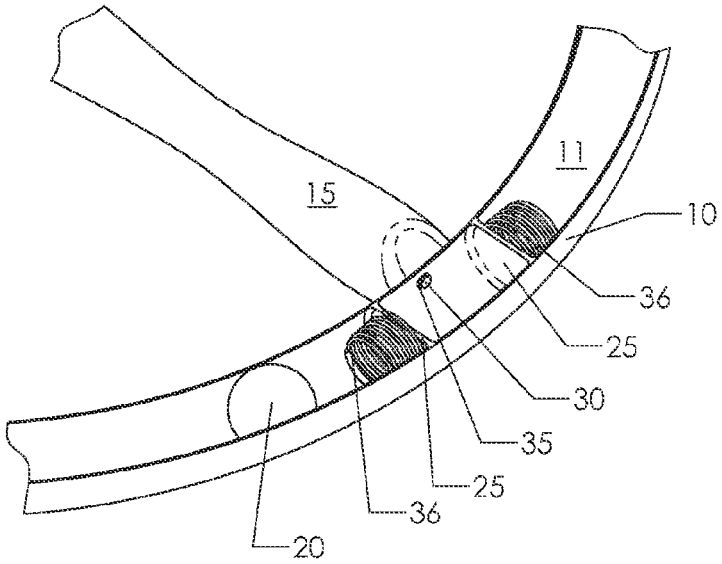
FIG. 4 depicts a close-up perspective view of another embodiment of the device of the present invention.

As shown in FIGS. 1-2 and FIG. 4, internal bumpers 25 may be disposed within the toroidally shaped inner chamber 11 to separate the inner chamber 11 into two or more interior spaces. In a preferred embodiment four internal bumpers 25 may be used to separate the toroidally shaped inner chamber 11 into four interior spaces. The majority of the volume of such an inner chamber 11 may comprise two semicircular pathways with each having at least one mobile element 20 disposed therein. The four internal bumpers 25 may further define a void space disposed between each of the two semicircular chambers and immediately adjacent each of the first end 16 and the second end 17 of the handle 15. Such void spaces may be used to provide or facilitate access to the connection points between the handle 15 and the ring element 10 where the handle 15 is either permanently affixed or removably affixed to the ring element 10. The internal bumpers 25 may comprise a flat, convex, or concave surface that interacts with the at least one mobile element 20 and provides a stopping point for the at least one mobile element's 20 range of motion or travel within the toroidally shaped inner chamber 11.

Figure 5:
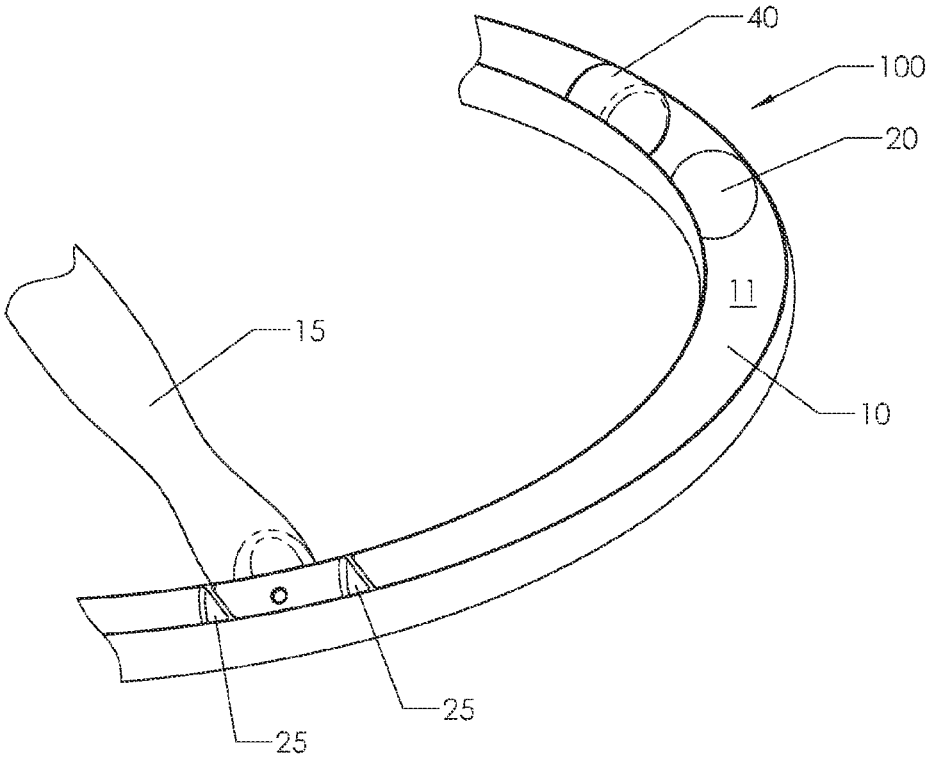
FIG. 5 depicts a close-up perspective view of still another embodiment of the device of the present invention.

In an alternate embodiment, the surfaces of the internal bumpers 25 that interact with the at least one mobile elements 20 may further comprise at least one resilient insert 40 that may include but is not limited to a spring, cylindrical-shaped resilient material, or any other resilient or soft material of any shape known within the art. In one embodiment, as shown in FIG. 4, the at least one resilient insert 40 may be secured to the surface of the internal bumper 25 that contacts the at least one mobile element 20 and provide a rebounding spring action and/or dampen the sound of the at least one mobile element 20 when the at least one mobile element 20 reaches the end of its range of motion or travel within the toroidally shaped inner chamber 11. In still another embodiment, the at least one resilient insert 40 may remain movable within the inner chamber 11 of the ring element 10 sharing the space with at least one mobile element 20. In a preferred embodiment, as shown in FIG. 5, the at least one resilient insert 40 may comprise a generally cylindrical configuration and may have an outer diameter sized less than the inner diameter of the toroidally shaped inner chamber 11. Additionally, the at least one resilient insert 40 may have a roller bearing inserted therein to allow for unobstructed motion of the at least one resilient insert 40 within the inner chamber 11. In alternate embodiments the at least one resilient insert 40 may comprise a plurality of resilient inserts 40 including but not limited to two, three, four, five, or six resilient inserts 40 disposed within the inner chamber 11 and the potential internal spaces thereof and/or a plurality of resilient inserts 40 fixed to the surface of one or more internal bumpers 25. The scope of the present invention further includes the use of a plurality of resilient inserts 40 wherein each embodiment may be used either alone or in any combination with other embodiments of the at least one resilient inserts 40 (e.g. springs used along with cylindrical-shaped resilient material).

Figure 6:
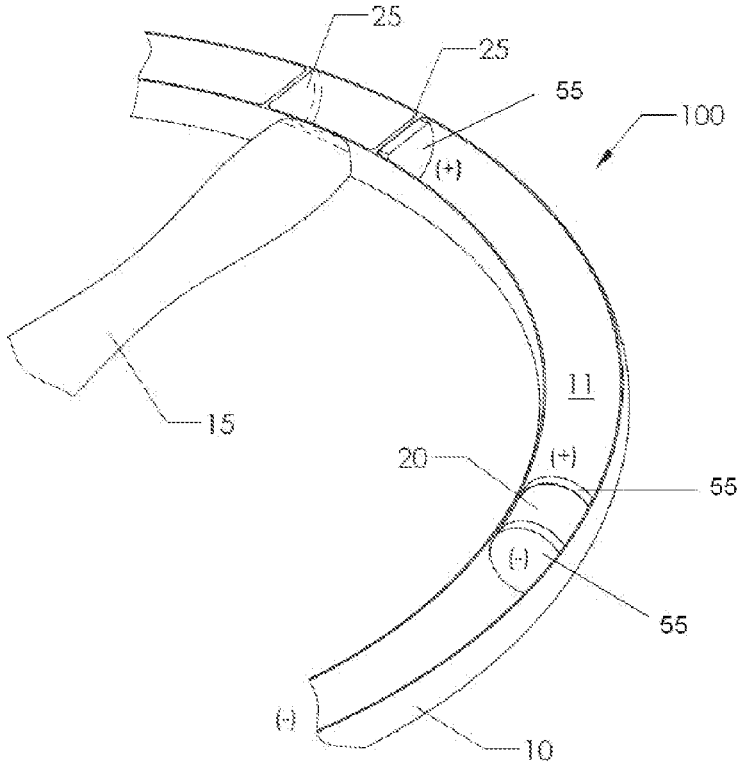
FIG. 6 depicts a close-up perspective view of yet still another embodiment of the device of the present invention.

Still another alternate embodiment, as shown in FIG. 6, may comprise at least one mobile element 20 having at least one magnet member 55 thereon. Additionally, at least one magnet member 55 may also be further incorporated onto one or more internal bumpers 25, at least one resilient insert 40, one or more springs 36, or other resilient members to provide a repulsive magnetic force as the at least one mobile element 20 and its at least one magnet member 55 thereon approaches any of these other structures having at least one magnet member 55 thereon as well. In this manner, opposing magnetic forces may provide and/or assist in slowing and/or stopping the continued motion of the at least one mobile element 20 as it approaches the end of its range of motion or travel within the inner chamber 11. Opposing or repulsive magnetic forces between the at least one mobile element 20 having at least one magnet member 55 thereon and any structures and/or surfaces in close proximity (e.g. an internal bumper 24, a resilient insert 40, a spring 36, or other resilient member) may provide a rebounding magnetic force and/or assist in reducing or slowing the speed of the at least one mobile element 20 having the at least one magnet member 55 thereon as it reaches the end of its range of motion or travel within the toroidally shaped inner chamber 11. In one exemplary embodiment, the at least one mobile element 20 may comprise a cylindrical structure, similar to the at least one resilient insert 40 described above, wherein the mobile element 20 may be weighted as needed and the diameter tolerances allow the at least one mobile element 20 to slide freely within the inner chamber 11. As shown in FIG. 6, a first flat end and a second flat end of such a cylindrically-configured mobile element 20 may have magnet members 55 disposed thereon. Any surface or structure that may approach and/or contact the at least one mobile element 20 and its at least one magnet member 55 thereon at the end of its range of motion within the inner chamber 11 (e.g. an internal bumper 24, a resilient insert 40, a spring 36, or any other resilient material) may comprise a magnet member 55 that provides a beneficial opposing or repulsive magnetic force as the two structures come within close proximity to each another.

In another embodiment or configuration (not shown), one or more removable elements may be removably attached to both the first end 16 and the second end 17 of the handle 15 thereby effectively replacing the ring element 10. The one or more removable elements may be available in different total weights to provide a variety of resistances for changing workout intensity. In a preferred embodiment, the one or more removable elements may comprise one removable element disposed at each of the respective ends 16,17 of the handle 15. The two removable elements may be of equal weight or one removable element may be of a greater weight than the other removable element to provide an additional workout variation. The one or more removable elements may be provided in near endless variety of shape configurations, wherein a preferred variation may include the spherical configuration. Each of the one or more removable element may further comprise an attachment structure that is complimentary to a reciprocal structure found on each end 16,17 of the handle 15. Such complimentary attachment structures provide for a removable connection between the handle 15 and the one or more removable elements and may include but are not limited to complimentary post and holes, screws and nuts or threaded recesses, tabs and grooves, and the like.

Figure 7:
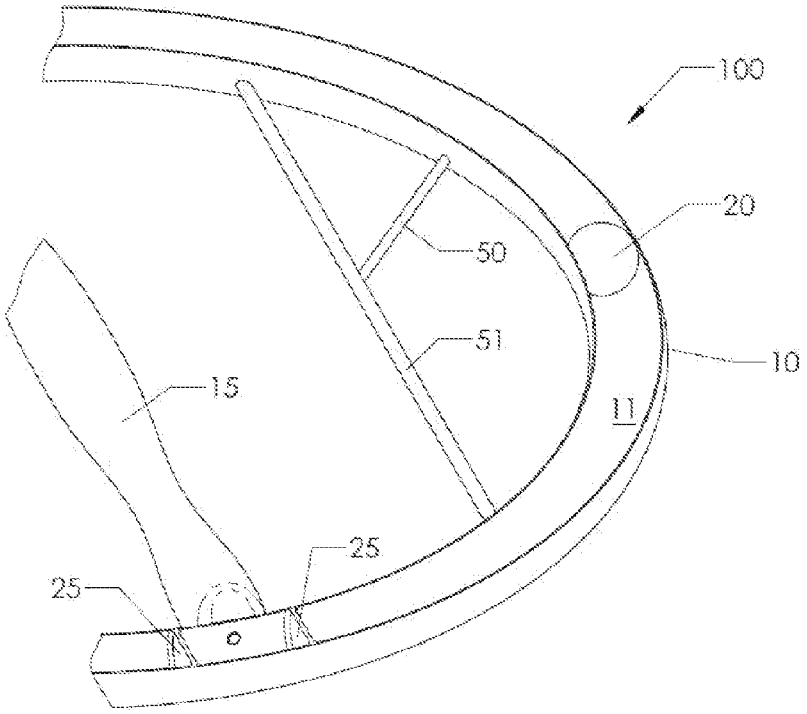
FIG. 7 depicts a close-up perspective view of yet still another embodiment of the device of the present invention.

In still another embodiment or configuration, a plurality of resilient members 50 and/or struts 51 may be disposed either between the handle 15 and the inner circumference of the ring element 10 or between separate portions of the inner circumference of the ring element 10. As shown in FIG. 7, any configuration of resilient members 50 and rigid struts 51 used alone or in combination may provide for alternate hand grip positions that allow additional exercise variations to be performed. Resilient members 50 in the form of bungee cords or other known pliant or resilient material allow a user to perform additional elastic resistance exercises while using the device 100 of the present invention. Connection points for the resilient members 50 and/or struts 51 may include end points independently selected from the ring element 10, the handle 15, other resilient members 50, and other struts 51.

Figure 8:
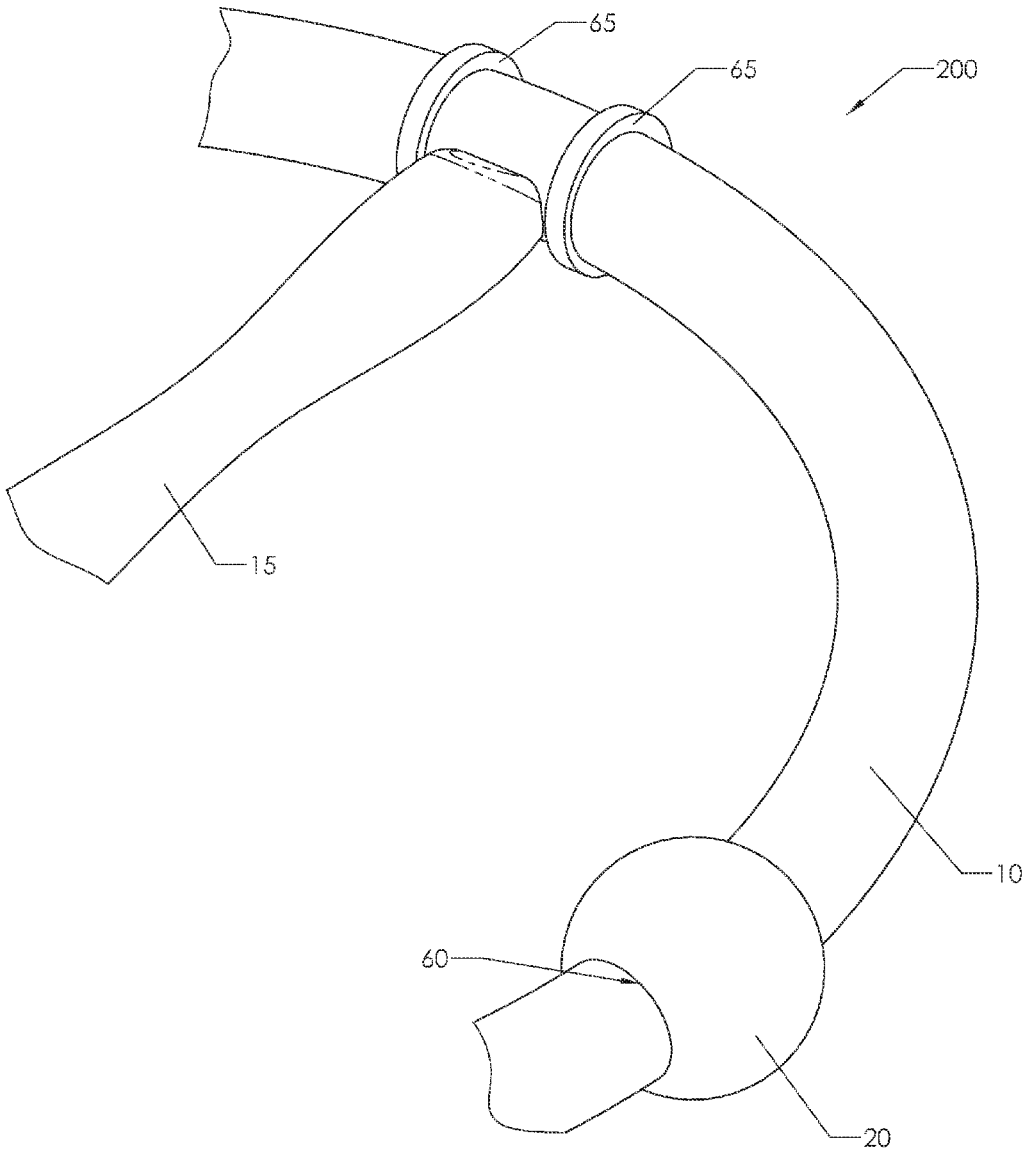
FIG. 8 depicts a perspective view of an external configuration embodiment of the device of the present invention.

The above-described embodiments comprise a generally internal configuration wherein the operative structures and elements are contained within the ring element 10 and function within the toroidally shaped inner chamber 11. As shown in FIG. 8, the same operative principles and structures may be applied in an external configuration 200 of the present invention as well. In an external configuration 200, the ring element 10 may comprise a structure having a solid cross-section wherein the other elements are disposed about the outer surface or circumference of the ring element 10. The handle 15 may be attached to diametrically opposed portions of the ring element 10 in the same manner as described above for the previous embodiments. The at least one mobile element 20 may comprise a sphere, a cylinder, or any other shape that may have a cylindrical hole 60 defined there through. The at least one mobile element 20 may slide upon the outer surface of the ring element 10 wherein the diameter of the cylindrical hole 60 is greater than the outer diameter of the ring element 10. The internal bumpers 25 of the internal configurations in the previous embodiments may be reconfigured as external bumpers 65 or flanges to provide a stopping surface for the at least one mobile element 20 on the outer surface of the ring element 10. As with the internal configurations described in detail above, an external configuration 200 may also further comprise a plurality of mobile element 20, at least one magnet member 55, one or more springs 36, at least one resilient insert 40, or other resilient material disposed about the outer surface of the ring element 10 either alone or in any combination thereof. Such additional or alternative structures provide the same function whether incorporated on an internal or external configuration of the present invention.

Accordingly the reader will see that, in use one or more embodiments of the present invention provide for a hand held exercise device 100 that may be grasped by either one hand or two hands of the user. User rotation of the device 100 within the plane of the ring element 10 provides a force applied to the hand(s) and arm(s) of the user that must be countered by muscle flexion by the user. For a less intense workout, a user may rotate the device 100 with the user's arms pointing toward the ground. For increased intensity, the user may rotate the device 100 while the device 100 is held up to resist gravity (e.g. at shoulder level, overhead, and the like). In a preferred embodiment, rotation of the device 100 causes the at least one mobile element 20 disposed within the toroidally shaped inner chamber 11 to roll, slide or otherwise move within the semicircular pathway of the preferred embodiment as the device 100 is repeatedly rotated clockwise and then counterclockwise within the plane of the ring element 10.

As the direction of rotation of the preferred embodiment is changed, the at least one mobile element 20 contacts an internal bumper 25 within the inner chamber 11 once the mobile element 20 has reached the end of its range of motion or travel within the inner chamber 11 causing a transfer of force to at least the hands and arms of the user. Muscle flexion on the part of the user may be required to stop the current rotation of the device 100 (as at least one mobile element 20 impacts the internal bumper 25) and then to impart a counter-rotation force that sends the at least one mobile element 20 back within its semicircular range of motion within the inner chamber 11. As the rotation of the device 100 slows and then stops due to either muscular flexion or the limits of the user's bodily range of motion for his or her hands, wrist, or arms, the at least one mobile element 20 begins to travel back through the semicircular inner chamber 11 and impacts the internal bumper 25 at the opposite end of the semicircular pathway of the inner chamber 11. The weight and the overall number of at least one mobile elements 20 may be changed to provide for varying exercise resistance level and/or intensity. Also, a user may desire to stop the rotation of the device 100 earlier via their own muscle flexion as opposed to ending rotation of the device 100 only when the user's bodily range of motion is reached.

While the above description contains much specificity, these should not be construed as limitations on the scope of any embodiment, but as exemplifications of the presently preferred embodiments thereof. Many other ramifications and variations are possible within the teachings of the various embodiments.

Thus the scope of the invention should be determined by the appended claims and their legal equivalents, and not by the examples given.

What is claimed is:

1. An exercise device, comprising:

a ring element having a toroidally shaped inner chamber therein and containing a split-open top with a slit in open communication with said inner chamber, said slit purposed for accessing an entirety of said inner chamber, said slit defining a width;

a removable handle disposed across a diameter of said ring element, wherein said handle comprises a first end and a second end each in communication with opposing sides of said ring element; and at least one mobile element disposed and movable within said toroidally shaped inner chamber to provide inertial resistance, wherein an external diameter of said at least one mobile element is less than an internal diameter of said toroidally shaped inner chamber and greater than said width of said slit; said ring element comprising two or more internal bumpers that separate said toroidally shaped inner chamber into two semicircular pathways and two attachment zones, wherein each of said two semicircular pathways has at least one mobile element disposed therein and each of said two attachment zones is disposed adjacent said first end and said second end of said handle, respectively.

2. The exercise device of claim 1, wherein said at least one mobile element comprises:

at least one ball having a diameter greater than a width of said slit.

3. The exercise device of claim 2, wherein said slit comprises:

a concave, C-shaped cross section that has an arc length that is greater than the diameter of said ball.

4. The exercise device of claim 3, wherein said slit allows for a snap-fit of said at least one ball within said toroidally shaped inner chamber.

5. The exercise device of claim 1, wherein said handle comprises:

a secure ergonomic gripping surface.

6. The exercise device of claim 1, wherein each of said first end and said second end of said handle further comprise;

a post and said ring element further comprises two postholes diametrically placed about said ring element, wherein said posts and said postholes provide two complimentary communication points between said handle and said ring element for securing said post.

7. The exercise device of claim 1, wherein said at least one mobile element comprises:

at least two balls with each of said two balls disposed within separate said at least two semicircular pathways.

8. The exercise device of claim 1, wherein said exercise device further comprises:

at least one sliding insert disposed within said inner chamber of said ring element between at least one of said internal bumpers and one of said at least one mobile element, wherein said at least one sliding insert is movable within said toroidally shaped inner chamber of said ring element.

9. The exercise device of claim 1, wherein said exercise device further comprises:

at least one sliding insert disposed within said inner chamber of said ring element, wherein said at least one sliding insert is secured to one of said internal bumpers.

10. The exercise device of claim 1, wherein said exercise device further comprises:

at least one spring disposed within said inner chamber of said ring element, wherein said at least one spring is movable within said toroidally shaped inner chamber of said ring element.

11. The exercise device of claim 1, wherein said exercise device further comprises:

at least one spring disposed within said inner chamber of said ring element, wherein said at least one spring is secured to at least one of said internal bumpers.

12. The exercise device of claim 1, wherein said exercise device further comprises:

at least two magnet members disposed within said toroidally shaped inner chamber of said ring element.

13. The exercise device of claim 1, wherein said exercise device further comprises:

at least two magnet members disposed within said toroidally shaped inner chamber of said ring element, wherein at least one of said two magnet members is fixed to at least one of said two internal bumpers and at least one of said two magnet members is fixed to a surface of said at least one mobile element wherein a magnetic repelling force is generated between said magnet member on said internal bumper and said magnet member on said mobile element as said mobile element with said magnet member moves into close proximity to said internal bumper with said magnet member.

14. The exercise device of claim 1, wherein said exercise device further comprises:

at least one strut providing a rigid grasping point.

15. The exercise device of claim 1, wherein said exercise device further comprises:

a plurality of resilient elements providing elastic grasping points wherein said plurality of resilient elements may have connection points with elements independently selected from the group consisting of said ring element, said handle, and said one or more struts.

16. The exercise device of claim 1, wherein said exercise device further comprises:

a plurality of resilient elements providing elastic grasping points wherein said plurality of resilient elements have connection points with elements independently selected from the group consisting of said ring element and said handle.

* * * * *